United States Patent [19]

McNelia et al.

[11] 4,333,400

[45] Jun. 8, 1982

[54] TWO STAGE PARACHUTE FUZE RECOVERY SYSTEM

[75] Inventors: John F. McNelia; Carl R. Peterson, both of Silver Spring, Md.

[73] Assignee: The United States of America as represented by the Secretary of the Navy, Washington, D.C.

[21] Appl. No.: 117,702

[22] Filed: Feb. 1, 1980

[51] Int. Cl.³ ..... F42B 4/08

[52] U.S. Cl. ..... 102/348; 102/352; 102/354; 102/387; 102/473

[58] Field of Search ..... 102/348–354, 102/387, 473, 346

[56] References Cited

U.S. PATENT DOCUMENTS

| | | | |
|---|---|---|---|
| 3,038,407 | 6/1962 | Robertson et al. | 102/348 X |
| 3,121,584 | 2/1964 | Bendl | 102/387 X |
| 3,122,392 | 2/1964 | Benditt et al. | 102/387 X |
| 3,221,656 | 12/1965 | Sutten | 102/348 |
| 3,730,099 | 5/1973 | Schopp | 102/348 X |

*Primary Examiner*—Peter A. Nelson

*Attorney, Agent, or Firm*—R. S. Sciascia; A. L. Branning; J. C. LaPrade

[57] ABSTRACT

A two stage parachute recovery system for use in recovering fuzes or other sensitive equipment from a projectile that has been launched from a gun barrel wherein explosive means are successively detonated by a timing mechanism and by centrifugal force imparted to the projectile respectively so as to deploy each of the said parachutes and to thereby recover the fuze before impact.

11 Claims, 7 Drawing Figures

TWO STAGE PARACHUTE FUZE RECOVERY SYSTEM

BACKGROUND OF THE INVENTION

In the past the Navy has found that there is a real need to gun launch a projectile with a fuze affixed to the forward end in a manner so as to recover the undamaged fuze.

In the past the recovery of fuzes that are affixed to the external forward end of projectiles has been impossible where low gun elevation angles are used.

Although a single stage parachute recovery system was developed in the early 1960s, such a system cannot be used at gun elevation below 19 degrees.

In present day testing of fuzes it is often times necessary to fire a test round at targets mounted within a few hundred feet of the ground. The recovery of the undamaged frontally mounted fuze for test purposes depends upon the efficiency of the recovery system. If the fuze impacts the ground at a high velocity it will be destroyed thereby making further tests or analysis impossible. In such a case the prior condition of the fuze cannot be analyzed and no determination can be made as to the cause of a failure of a fuze to properly detect the target. When a fuze is allowed to impact the earth at a high velocity the fuze is destroyed. It is obviously advantageous to recover the undamaged fuze so that analysis is possible.

In many situations the Navy has need to test and determine the conditions of fleet issued ammunition fuzes, particularly in a quantity of fuzed ammunition projectiles where there has been a fatal or near fatal malfunction.

For example, if a projectile explodes in a gun barrel or shortly after muzzle exit all fuzes and projectiles in the suspected lot may be declared unfit for use. In such a case it is obviously advantageous to test the fuzes under ordinary firing conditions without incurring further risk to personnel. In such cases the recovery of the fuze is critical to the test procedure. If the test exonorates the fuze the lot of fuzes may be used at great saving of re-procurement cost to the Government.

In another situation the recovery of fuzes on rounds or projectiles fired for test purposes saves a great deal of time in doing research and development. Without a means to recover fuzes after test firing the alternative test procedures in the laboratory are very time consuming. In addition, the laboratory testing of fuzes is not nearly so satisfactory as in gun launched testing after conventional firing.

When a failure of a projectile occurs at sea, the suspected rounds have to be shipped to a test facility for testing to determine the cause of failure. While live rounds are not used for testing, the gun-launched testing of fuzes with the recovery system of the instant invention represents such a great savings in time. The cycle time from failure of rounds in a distant field position to shipment of the suspected rounds with fuzes to a test facility, followed by analysis and testing and return of the rounds to the field when the present invention is used, is reduced from a few months to a matter of weeks or days. In short, the recycle testing time of fuzes is greatly reduced by use of the present invention.

Thus, it is also readily apparent that the Navy has great need to have a reliable system for fuze recovery.

The two stage parachute recovery system of the disclosed invention is such a system.

This two stage parachute recovery system solves a long standing problem for the Navy. In addition it saves both time and expense in research and development of experimental fuzes.

SUMMARY OF THE INVENTION

The instant invention comprises a two stage recovery system in a gun fired projectile wherein a preset timing means actuates an explosive at a predetermined time. The actuation of the explosive drives the recovery system out of the projectile and deploys the first stage parachute. This first stage parachute decreases the velocity from an initial velocity as high as MACH 2.5 to a velocity which is compatible with the design of the main stage parachute design. When the recovery system is ejected from the projectile a delay actuator or other timing device is initiated by the centrifugal forces in the rotating gun launched projectile. At the end of a predetermined time a second explosive means is initiated by the output of the delay actuator timing device. The explosive force releases the housing means of the second, or main stage parachute from the outer fuze adapter on which the test fuze is mounted and facilitates deployment of the second, or main stage parachute that is housed near the midsection of the recovery system. This allows deployment at a time that is prearranged by a combination of the timing means and the delay actuator device.

It is therefore a general object of the instant invention to provide a recovery system for fuzes where a test shell is gun launched at an elevation angle of 2.7° or more.

It is a further object of the invention to provide preset preferred testing times between 5.5 and 35 seconds. The testing time for large bore projectiles may run as long as 200 seconds or even longer i.e., from 5.5 to 250 seconds.

It is a further object of the invention to provide a two stage parachute fuze recovery system where each of two parachutes are deployed by explosive means.

It is therefore another general object of the present invention to provide means to rapidly decelerate a fuze when mounted on a shell or shell adapter from about 2400 ft per second to about 30 ft per second.

Other objects and advantages of the present invention will be readily appreciated as the same becomes better understood by reference to the following detailed description when considered in connection with the accompanying drawings.

BRIEF DESCRIPTION OF THE DRAWINGS

In FIG. 1 the fuze is shown separately from its usual position on the shell.

DETAILED DESCRIPTION OF THE PREFERRED EMBODIMENT

Figure 1:
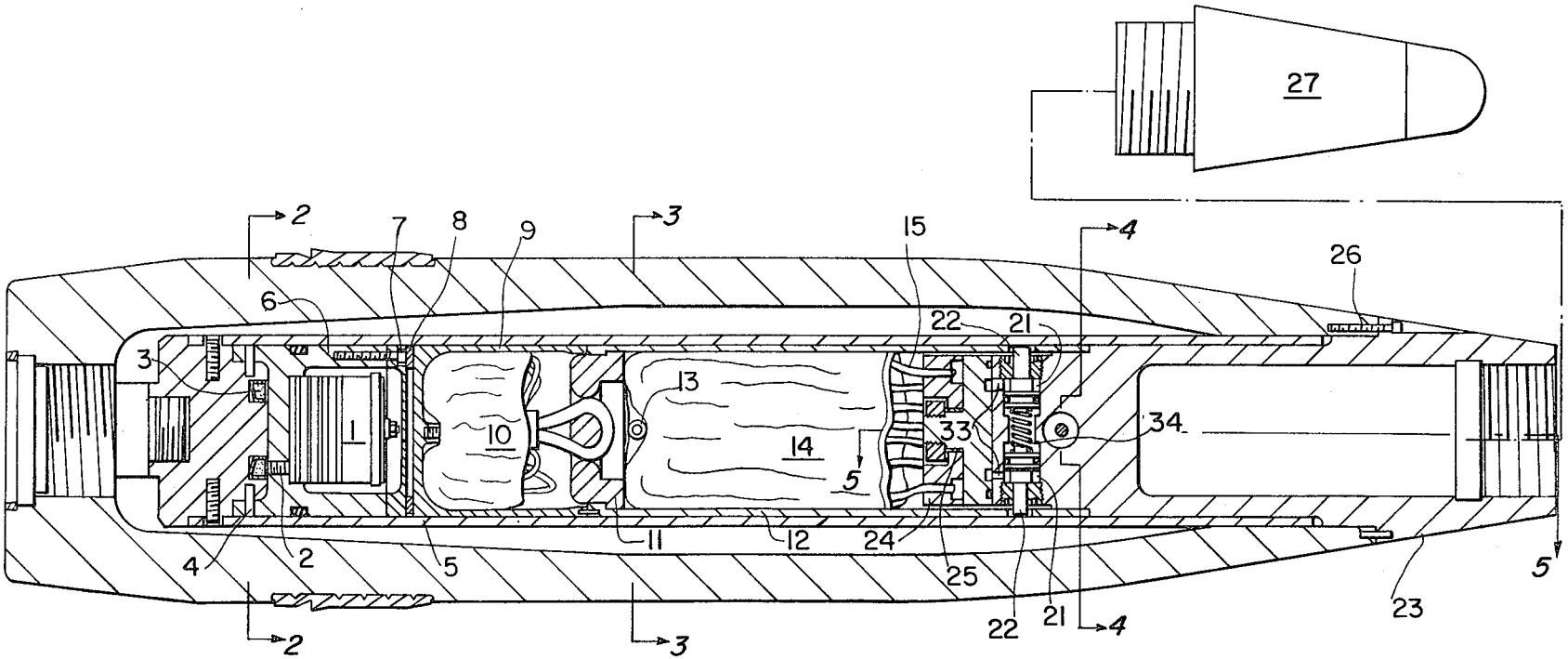
FIG. 1 is a side section of the projectile taken along the longitudunal center line of the projectile and recovery system.
Figure 2:
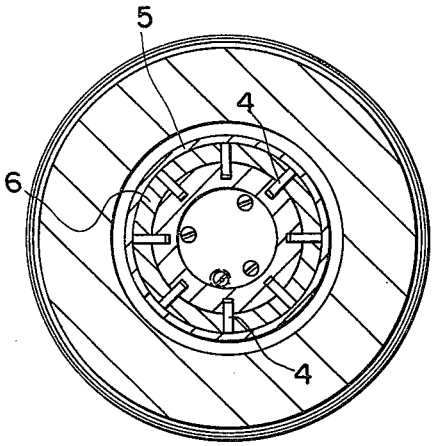
FIG. 2 is a cross-sectional view taken in a plane along line 2—2 of FIG. 1.
Figure 3:
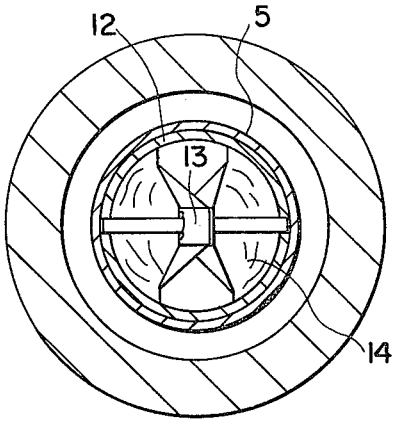
FIG. 3 is a cross-sectional view taken in a plane along line 3—3 of FIG. 1.
Figure 4:
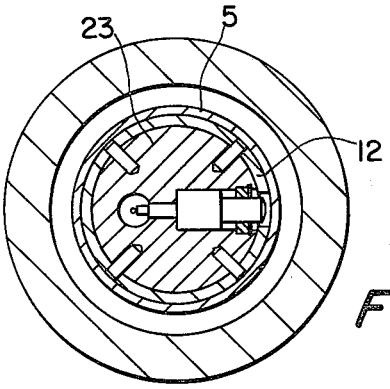
FIG. 4 is a cross-sectional view taken in a plane along line 4—4 of FIG. 1.
Figure 5:
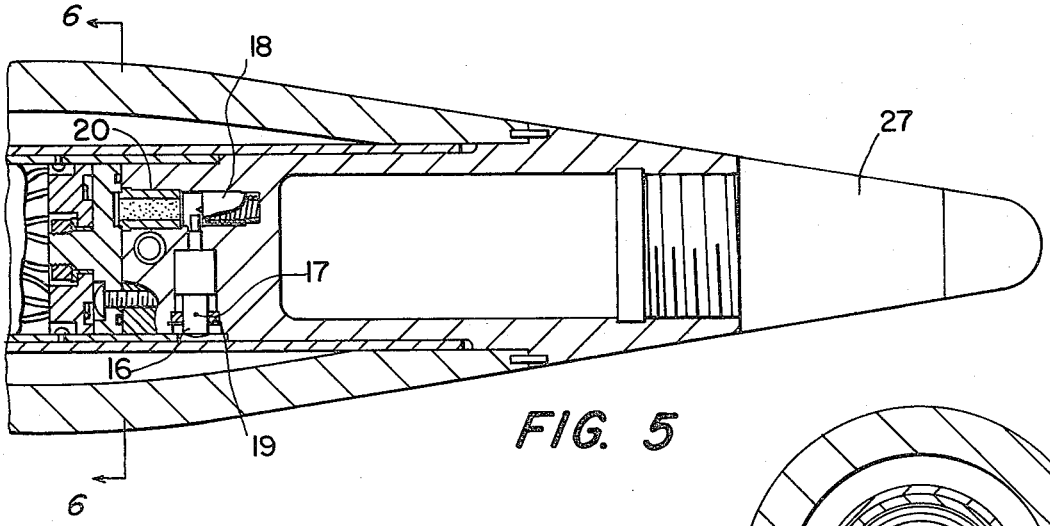
FIG. 5 is a cross-sectional plan view of the forward end of the recovery system along line 5—5.
Figure 6:
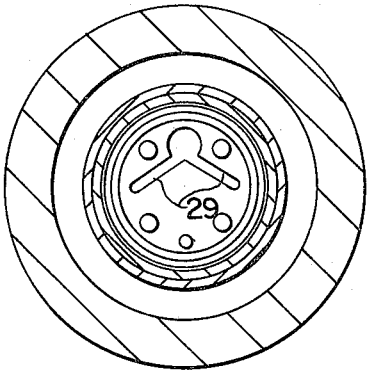
FIG. 6 is a cross-sectional view taken in a plane along line 6—6 of FIG. 5.

A five inch/54 projectile containing the 2-stage recovery system is shown in FIG. 1. Before assembly, the desired actuation time from 5.5 to 35.0 seconds or longer is preset into the mechanical timer (1). Item (2) is an explosive percussion primer which is initiated by the timer when the preset time has elapsed after the firing of the projectile. The primer in turn ignites the explosive expelling charge (3) which causes shearing of four of the eight pins (4) and tensile failure of four screws (26) and ejects the recovery system from the projectile.

The guide tube (5) remains within the projectile.

The timer housing (6) and attached cover (7) abuts the shock absorber (8) which is a resilient cork and rubber ring glued to the aft cup (9). The purpose of this shock absorber is to attenuate the transmission of high frequency shock waves from the expelling charge (3) thru the structure into the test fuze (27). At ejection, these parts fall away allowing the first-stage parachute (10) to deploy. This parachute is attached to plate (11) which is free to swivel on the aft end of tube (12). Plate (11) is held in place by pin (13) which also serves as an anchor for the fabric sleeve (14) into which the second or main parachute (15) is packed. The centrifugal force caused by the spin imparted to the shell in the gun barrel (30) causes the slider (16) to move outward against the guide tube (5), thus shearing the restraining wire (17). The tang on the opposite end of the slider (16) restrains the spring loaded striker (18). When ejection from the projectile occurs, the slider (16) moves outward against the bushing (19) thus, releasing the striker (18). This initiates the 2.3 second delay actuator (20). At the end of the 2.3 second delay, the actuator fires and an explosive pressure is transmitted via two passageways to the two chambers (21). The two spring loaded pistons (22) which engage with holes in tube (12) and lock it to the fuze-shell adapter (23) are driven inward. The retraction of the pistons (22) releases the tube (12) which is pulled free by the first-stage parachute, thus deploying the second or main parachute (15) which is attached to the fuze-shell adapter (23) by a swivel plate (24) which is free to turn on the bearing (25). The second stage parachute retards the fuze to an impact velocity of approximately 30 feet per second, at which speed the fuze is not damaged by ground impact.

The fuze, (27) is therefore protected from high velocity impact by use of the two stage parachute recovery system.

Although a recovery system for a five inch projectile has been described, the system will work with any shell that can be launched through a gun barrel. It is also essential that the barrel of the gun be rifled so as to impart centrifugal force to the shell by spinning as it travels through the barrel.

The mechanical timer (1) is equivalent to a number of electrically operated timers that can be substituted therefor. If an electrical timer were substituted for a mechanical timer it could be battery operated. In such case, if the batteries were sufficiently powerful the stab primer (2) could be eliminated and the explosive charge (3) could be detonated by an electrical charge.

The timer (1) may obviously be set at anytime desired. Where low target trajectory of 100 to 300 feet above the ground is utilized the preset timer will usually be set within the range of 5.5 seconds to 7 seconds. Other more precise timers may be used.

The shear pins (4) are sheared and the screws (26) fail in tension because of the great force in the first explosive that produced a large expelling force. The deployment of the first stage parachute is dependent upon the ejection of the recovery system from the shell casing. As this is a critical step in the recovery system the powder charge may be increased or decreased in size and weight to make sure that the recovery system is properly expelled from the shell hardware thereby simultaneously deploying the first stage parachute.

The first stage parachute (10) and the second-stage parachute (15) may be made of Kevlar parachute fabric. Other conventional parachute fabric material such as nylon may be used in addition or in lieu of Kevlar. Kevlar is however preferred for the first stage parachute.

The centrifugal force imparted to the shell casing by spinning the shell in the gun barrel is a critical part of the staging process. In the staging process the centrifugal force caused by the spin imparted to the shell in the gun barrel forces the slider (16) to move outward against the guide tube (5) shearing the restraining wire (17). The restraining wire restrains the slider during assembly and disassembly of the recovery system and the tang on the opposite end of the slider retains the spring loaded striker (18). During launch when spin reaches a minimum of 90 revolutions per second the slider moves to the inner wall of the guide tube (5) after severing wire (7). After ejection of the recovery system from the projectile, the centrifugal force causes the slider (16) to move further outward against the bushing (19) which movement allows the spring loaded striker (18) to strike the delay actuater (20).

The centrifugal force causes a first movement of the slider (16). After ejection of the recovery system from the guide tube (5) the slider (16) moves out further from the center allows the tang to move away and thereby allows the spring loaded striker to fire the explosive actuator (20).

The delay actuator is a cylinder containing a stab primer, a delay column and an output charge. The length of the delay column and the chemical makeup of the delay powder charge determine the length of time it will take for burning to be completed. When the burning has been completed the high temperature at the end of the delay column will ignite or detonate the output charge. Although the delay actuator in the preferred embodiment is a delay time of 2.3 seconds, other times for ignition and detonation of the explosive charge, either longer or shorter can be preselected by varying the amount or type of delay powder. The time delay can be in the range of from 1 to 10 seconds. Other delay actuators could obviously be used.

In an alternative to the striker as a means to actuate the delay device an electronic firing mechanism may be substituted.

In such an electronic device, that would be battery operated, the electronic firing device could ignite the powder in the delay actuator or the electronic firing device could provide the delay time and then detonate the explosive charge that supplies pressure to the pistons (22) that release the cylindrical housing (12) so as to deploy the second or main stage parachute (15).

In the preferred embodiment the explosive charge forms a pressure that is transmitted through passageways (29) and holes (33) to drive the pistons back against the spring (34), thereby releasing the cylindrical housing-tube (12).

When the tube (12) is released or un-locked from the fuze-shell adapter (23) the first stage parachute (10) that has been deployed, usually for several seconds exerts a pulling force on cylindrical housing (12). When the cylindrical housing (12) is pulled free the second stage parachute is deployed.

It has been found that the first stage parachute reduces the velocity of the fuze from about 2400 ft per second to approximately 370 ft per second. The second stage parachute reduces the velocity of the fuze and shell adapter to 30 ft per second or less.

Figure 7:
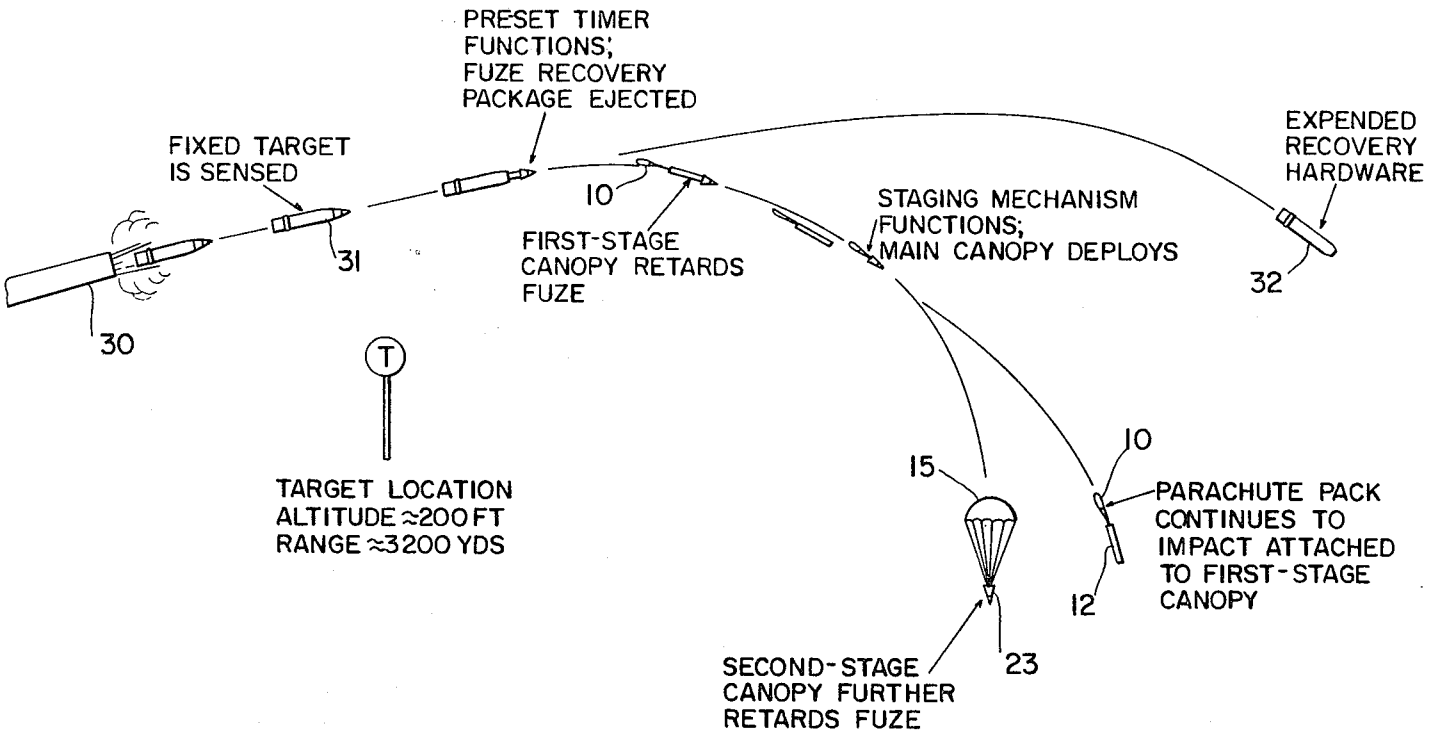
FIG. 7 is a pictorial view tracing the gun-launching of the projectile and the two stages of recovery of the fuze.

In FIG. 7 the gun (30) launches the shell assembly (31) with the fuze attached. When the preset timer functions the fuze recovery system is ejected. The first stage parachute or canopy (10) is deployed with the cylindrical housing (12), fuze and fuze-shell adapter (23) intact. The expended shell (32) falls away. After a delay of 2.3 seconds the staging mechanism functions so as to deploy the second stage parachute. The cylindrical housing (12) with the first stage parachute attached is released and is pulled away. The fuze and fuze-shell adapter are slowed to a velocity of 30 ft per second or less and are recovered without any substantial damage. The target in FIG. 7 is illustrated as $\tau$ and shows its possible location with respect to deployment of the first parachute.

It can be thus seen that the present invention provides an improved two stage parachute-fuze recovery system. Obviously, many modifications are possible in the light of the above teachings.

We claim:

1. A gun shell type projectile including an external frontally mounted fuze member, said gun shell type projectile comprising in combination a generally cylindrical outer shell casing, containing within the body of the projectile a longitudinal cavity, a two stage parachute-fuze recovery unit mounted within the said longitudinal cavity comprising in combination a first stage parachute, a first explosive means, a timing device and primer with associated means to activate said primer at a pre set time; said first explosive means being located between the base of the shell casing and the base of the recovery unit so that upon ignition of the said first explosive means ejects the recovery unit from the shell casing by exerting positive pressure on the opening between the shell casing and on the base of the recovery unit the said parachute recovery system, explosive means to eject the said two stage recovery unit from the shell casing; means to deploy the first parachute at the time the recovery unit is ejected from the unit and a second explosive means that releases the second stage parachute, wherein the second stage parachute is released by said second explosive means that is actuated by the centrifugal force exerted by the spin imparted to the shell casing by the gun barrel.

2. The gun shell type projectile of claim 1 wherein said first timing means actuates a percussion primer to detonate the first explosive charge.

3. The gun shell type projectile of claim 1, including a fuze shell adapter and wherein said cylindrical outer shell casing houses a second stage parachute attached to the fuze shell adapter and mounted in the rear of said housing.

4. The gun shell type projectile parachute of claim 3 wherein the detonator means for detonating the said first explosive charge is actuated by the centrifugal force exerted upon the shell in the gun barrel.

5. The projectile of claim 1 wherein the associated timing and detonator means are provided to eject the recovery system from the shell housing at the same time that the first stage parachute is simultaneously deployed.

6. The projectile of claim 3 wherein the timing means actuates a percussion primer that detonates said first explosive charge.

7. The gun shell type projectile parachute fuze of claim 3 wherein the locking means comprises a pair of spring loaded pistons that lock the first cylindrical housing to the second cylindrical housing.

8. The gun shell type projectile parachute fuze of claim 6 wherein detonation of the second explosive charge is caused by a slider that is actuated by centrifugal force the movement of the slider releases a spring driven striker, the release of said striker causing a delay actuator to detonate said explosive charge that produces the pressure necessary to retract the pistons from the cylindrical housing.

9. The gun shell type projectile parachute fuze of claim 7 wherein detonation of an explosive charge forces the retraction of the two pistons from the second cylindrical housing.

10. The gun shell type projectile parachute of claim 3 wherein the system is fastened to a conventional shell casing by fastening means that can be broken away so as to allow the recovery system to be ejected from the shell casing.

11. The gun shell type projectile parachute of claim 1 wherein at least one of the parachutes is comprised of a Kevlar material.

* * * * *